US005083680A

United States Patent [19]

Plough Harold

[11] Patent Number: 5,083,680

[45] Date of Patent: Jan. 28, 1992

[54] DISPENSER FOR HOLDING AND SELECTIVELY SUPPLYING ONE OF TWO SPICES THEREIN

[76] Inventor: Plough Harold, 2000 W. Illinois Ave., Aurora, Ill. 60506

[21] Appl. No.: 667,568

[22] Filed: Mar. 11, 1991

[51] Int. Cl.[5] ..... A47G 19/24

[52] U.S. Cl. ..... 222/142.1; 222/564

[58] Field of Search ..... 222/142.1-142.9, 222/196.5, 457.5, 459, 484, 564, 196.1

[56] References Cited

U.S. PATENT DOCUMENTS

| | | | |
|---|---|---|---|
| 1,674,233 | 6/1928 | Williams | 222/142.1 |
| 1,927,149 | 9/1933 | Belefant | 222/142.4 |
| 2,135,848 | 11/1938 | Sandstrom | 222/142.4 |
| 2,173,542 | 9/1939 | Simington | 222/142.4 |
| 2,395,613 | 2/1946 | Crowell | 222/142.1 X |
| 2,606,691 | 8/1952 | Lindly | 222/142.2 |
| 2,734,663 | 2/1956 | Lucas | 222/142.1 |
| 2,812,114 | 11/1957 | Atrill | 222/142.4 |

*Primary Examiner*—Michael S. Huppert
*Assistant Examiner*—Anthoula Pomrening
*Attorney, Agent, or Firm*—Kajane McManus

[57] ABSTRACT

The dispenser holds two spices therein and selectively dispenses one of the spices at a time from a top surface thereof. The dispenser includes a parabolic, oval casing having a top surface which angles downwardly in a central area between narrow ends of the oval. The top surface is formed of two planar members which each engage a central upright and lock to the oval casing in a snap fit manner. Each top surface member includes a recess in the area of engagement to the central upright which creates a transverse slit in a center area adjacent the central upright, the slits being separated from one another by the central upright. The central upright continues downwardly, along the length of the casing to divide the interior of the casing into two sections. Each section further includes a slotted radially upwardly directed flange element extending from the upright across the horizontal extent of the section. The flange element controls the rate of dispensing and assists in returning any unused spice to the storage section of the chambers below the flange.

3 Claims, 2 Drawing Sheets

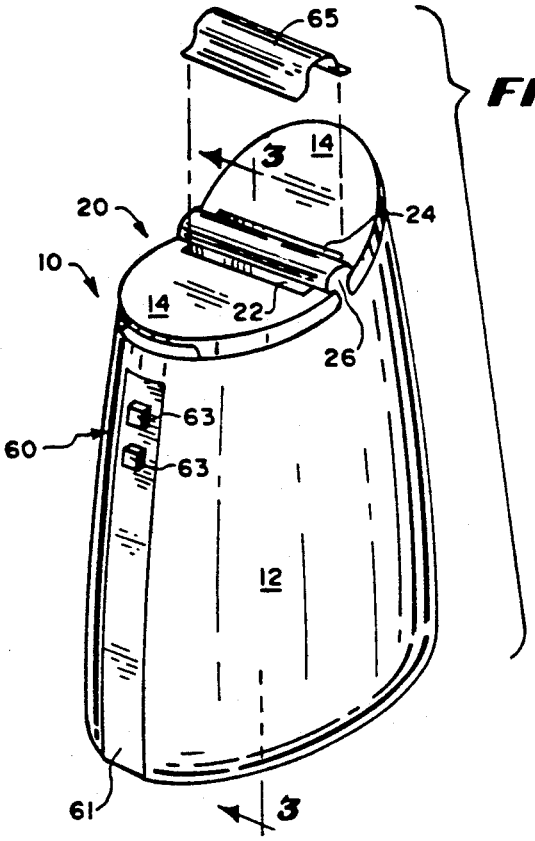
FIG. 1
FIG. 2
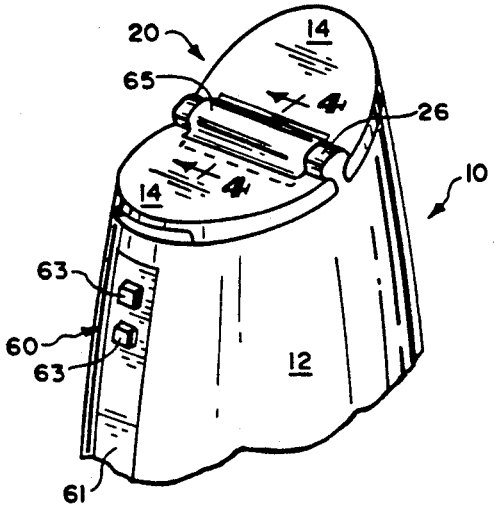
FIG. 4
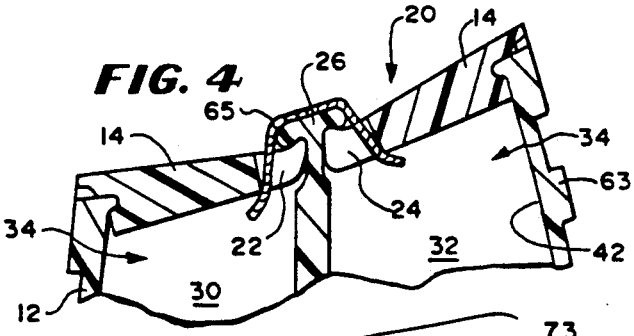
FIG. 3
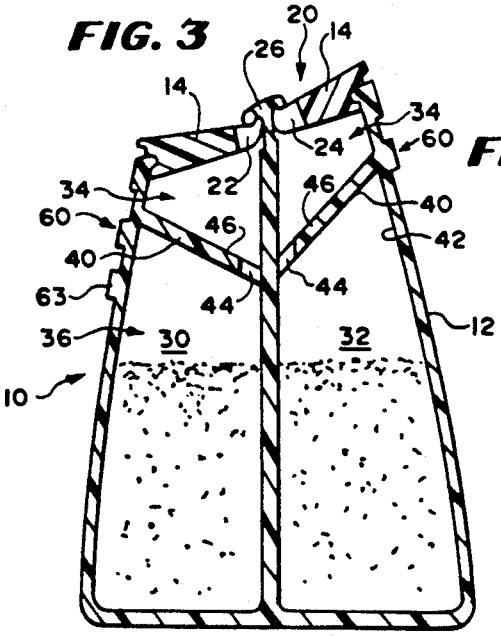
FIG. 5
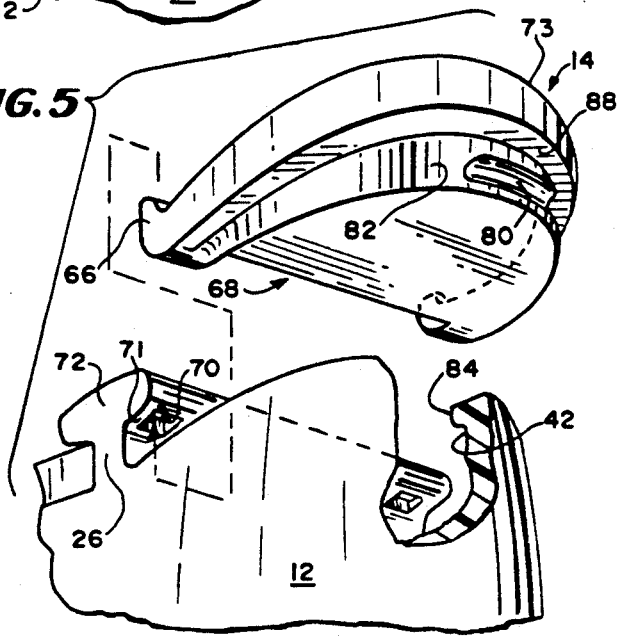

DISPENSER FOR HOLDING AND SELECTIVELY SUPPLYING ONE OF TWO SPICES THEREIN

BACKGROUND OF THE INVENTION

The present invention relates to a spice dispenser adapted to hold two spices therein and selectively dispense one of the spices at a time, as desired. More particularly, the dispenser provides either salt or pepper from a substantially planar top surface thereof, without allowing combination of the spices, either within the dispenser or during dispensing of same.

PRIOR ART

Heretofore various dispensers for holding and dispensing more than one spice per single dispenser have been proposed.

For example, the Gebhardt U.S. Pat. No. 942,138 discloses a condiment shaker designed to hold both salt and pepper, or two other such condiments therein in separate compartments. The shaker includes a cylindrical receptacle divided into two compartments by a central vertical partition and includes a semispherical cap. Secured to each side of the partition is a downwardly inclined partition at a position along the top half of the central partition. The cap includes rows of perforations on each side of a central unperforated zone and upon shaking action, and turning the shaker on one side, a condiment in a then lower compartment exits the perforations aligned therewith while the condiment in the upper compartment engages the inclined partition and does not flow past it, being kept from reaching its corresponding perforations.

The Schneider U.S. Pat. No. 1,362,442 discloses a combined salt and pepper shaker which includes a body divided into two vertical sections by a centrally arranged partition. An upper portion of the body is provided with a pair of outwardly directed necks through which the content of a corresponding section may be shaken when a chosen neck is downwardly directed. To ensure that only one condiment is discharged at a time, downwardly inclined baffles are engaged to each side of the vertical partition creating a restricted discharge path in each vertical section.

The Blum U.S. Pat. No. 1,085,660 discloses a salt and pepper shaker comprising a cylindrical hollow body, the interior of which is divided by a medial longitudinally extending partition into two compartments. An open end of the body is closed by a removable circular closure which includes two sets or lines of discharge openings inclined or angularly disposed therein, with inner ends of the passages registering with an outer edge of the partition when the closure is in an operative position thereof. To prevent commingling of the spices, the edge of the partition is provided with V-shaped recesses on opposite sides thereof which register with the passages.

The Hart et al. U.S. Pat. No. 1,765,152 discloses a condiment holder for two separate powdered substances. Two different sized compartments are provided, each having a discharge spout and downwardly angled baffle walls therein for restricting the flow of substance to a respective discharge spout upon inversion of the holder and for preventing moisture from entering the compartment. The discharge spouts are at opposed circumferential locations along an upper area of a sidewall surface of the holder.

The Bounds U.S. Pat. No. 4,193,521 discloses a dual condiment dispenser having two separate compartments for use in separately dispensing two different condiments, such as salt and pepper. A container is divided into two separate compartments by means of a partition which runs vertically between the bottom and the top thereof. The top of the compartment is covered by a cap member which is removably attached thereto by suitable means, such as an interference fit. One or more apertures are formed in opposite portions of the sides of the cap member to form a condiment pouring outlet for each of the compartments. A baffle member is formed in the cap member opposite each of the outlets, each of said baffle members partially surrounding its associated outlet and having triangularly cross-sectioned deflector portions. The spices of the deflector portions are positioned directly opposite the apertures such that when the condiment is being shaken out of one of the compartments, the baffle will tend to prevent the condiment in the other of the compartments from being shaken out of its outlet.

Two other similar compartmented dispensing containers are disclosed in the Cianciolo U.S. Pat. No. 3,323,683 and the Vendel U.S. Pat. No. 1,954,719, each having the dispensing apertures thereof built into sidewalls of the dispenser body.

As will be described in greater detail hereinafter, the spice dispenser of the present invention provides a top dispensing surface, which provides for dispensing of one chosen spice at a time therefrom, providing unique interior isolator elements for isolating the spices from one another, both during storage and dispensing of the spices, as well as providing tactile indicia for indicating which spice will be supplied therefrom when the dispenser is used in the manner to be described hereinafter.

SUMMARY OF THE INVENTION

According to the invention there is provided a dispenser for holding two spices therein and selectively dispensing one of the spices at a time from a top surface thereof. The dispenser includes a parabolic oval casing having a top surface which angles downwardly in a central area between narrow ends of the oval. The top surface is formed of two planar members which each engage a central upright and lock to the oval casing in a snap fit manner. Each top surface member includes a recess in the area of engagement to the central upright which creates a transverse slit in a center area adjacent the central upright, the slits being separated from one another by the central upright which continues downwardly, along the length of the casing, to divide the interior of the casing into two sections. Each section further includes a slotted flange element extending thereacross, the flange element controlling the rate of dispensing as well as assisting in returning any unused spice to the storage area below the flange.

BRIEF DESCRIPTION OF THE DRAWINGS

Other objects and advantages of the invention will become more apparent upon perusal of the detailed description thereof and upon inspection of the drawings in which:

FIG. 1 is a perspective view of the spice dispenser of the present invention.

FIG. 2 is a perspective view of the top section of the spice dispenser and shows a cover thereof engaged within slits in the top surface of the spice dispenser.

FIG. 3 is a cross sectional view through the spice dispenser and is taken along line 3—3 of FIG. 1.

FIG. 4 is an enlarged cross sectional view through the top section of the spice dispenser and is taken along line 4—4 of FIG. 2.

FIG. 5 is an exploded perspective view, with portions broken away, of the top portion of the spice dispenser and shows the manner of engaging one of two top surface forming elements to the casing of the spice dispenser.

DESCRIPTION OF THE PREFERRED EMBODIMENT

Figure 6:
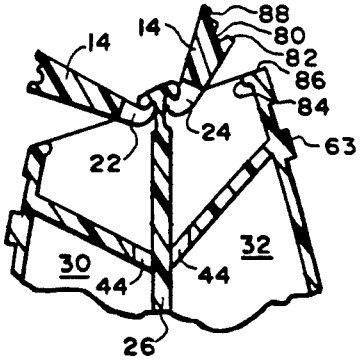
FIG. 6 is a cross sectional view through the top portion of the dispenser and shows the two top surface forming elements partially detached from the casing of the spice dispenser.
Figure 7:
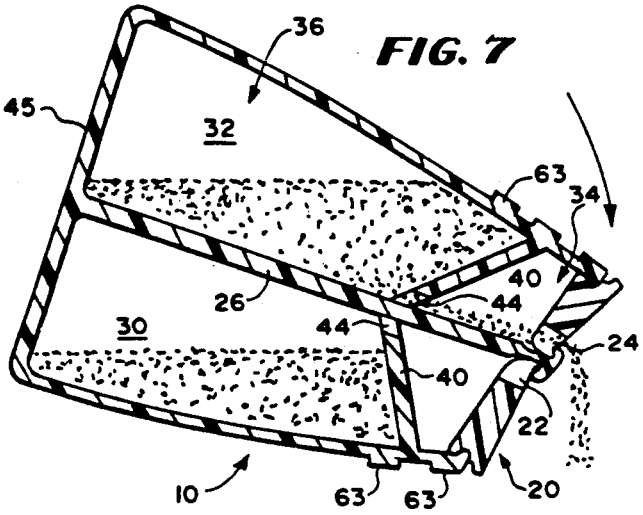
FIG. 7 is a cross sectional view through the spice dispenser and shows same tipped to provide a spice therefrom.
Figure 8:
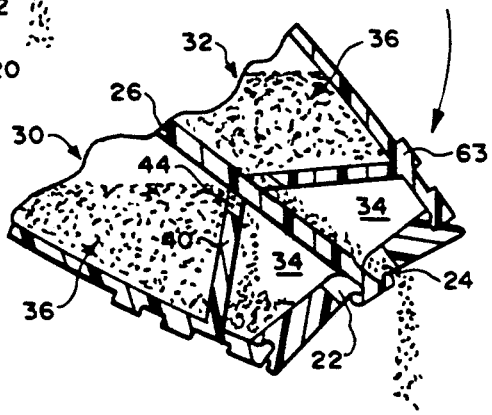
FIG. 8 is a cross sectional view through an upper portion of the dispenser of FIG. 7 and shows same tipped to a greater degree, while still only providing a single spice.

Referring now to the drawings in greater detail, there is illustrated in the drawings a two spice dispenser 10 made in accordance with the teachings of the present invention.

The spice dispenser 10 includes a casing 12 and two planar top surface forming elements 14 which lock onto the casing 12 in a snap fit manner as will be described in greater detail hereinafter.

The casing 12 comprises an oval, parabolic structure having a substantially planar top surface 20 which is slightly downwardly angled in a central area thereof between ends of the oval.

The top surface 20 has created therein, at an approximately central location therealong, two parallel slits 22 and 24.

The slits 22 and 24 are spaced apart by, and located to either side of, a central upright or dam member 26 which extends down the length of the casing 12, defining within the casing 12, two parallel upright chamber sections 30 and 32.

Each chamber section 30 and 32 is further divided into two vertical portions 34 and 36 by a flange member 40 extending from the dam 26 to the periphery of the respective chamber section 30, 32, such periphery being created by an interior surface 42 of the casing 12.

Each flange member 40 is seen to include an opening 44 at an edge 46 thereof which abuts the dam 26, the opening 44 being rectangular and positioned approximately centrally along the horizontal extent of the dam 26.

Turning now to the differences between the flanges 40, it will be seen that the flange 40 within the chamber section 32 is angled downwardly to a greater extent than the extent to which the flange 40 is downwardly angled in the chamber section 30.

The need for this disparity in angulation is best explained in connection with a study of FIGS. 7-11.

In this respect, when the dispenser 10 is placed into use, a decision must first be made as to which spice is to be dispensed. This is easily accomplished inasmuch as the casing 12 includes tactile indicia 60, either alone or in combination which visual indicia (not shown) which may be provided on the top surface 20 of the casing 12, to indicate which spice is located within which chamber section 30, 32. The indicia 60 in the preferred embodiment include a vertical flat 61 extending along each lateral side edge 62 of the casing 12, with either one or two nubs 63 located along an upper portion of each flat 61. Thus, on one side a single nub 63 is provided indicating the presence of a predetermined spice in the corresponding chamber section 32 and on the other side, two nubs 63 are provided, indicating the presence of a different predetermined spice in the corresponding chamber section 30.

Once the decision has been made, a user tilts the dispenser 10 in a manner to place, for example, the single nubbed side edge 62 upwardly, choosing the associated spice and placing the corresponding slit 24, leading to the chosen chamber section 32 vertically above the other slit 22 and corresponding chamber section 30 with a base 45 of the casing 12 being brought above the level the top surface 20 of the casing 12.

The chosen spice in the chamber section 32 then exits the lower holding portion 36 of the chamber section 32 exiting through the opening 44 in the flange 40 and then runs along the corresponding surface of the dam 26 and then falls out of the corresponding slit 24.

The spice in the opposite chamber section 32 collects against the underside of the flange 40 until it reaches the level of the opening 44 in the flange 40 and then flows through the opening 44. However, because of the angulation of the flange 40, the spice cannot reach the slit 22, and merely collects within the collection chamber 34 formed between the flange 40 and the top surface 20 of the casing 12, as shown.

Figure 10:
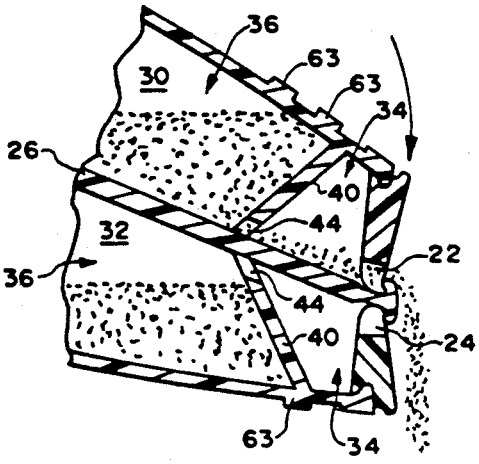
FIG. 10 is a cross sectional view similar to FIG. 7, but showing the second spice being provided from the dispenser.
Figure 11:
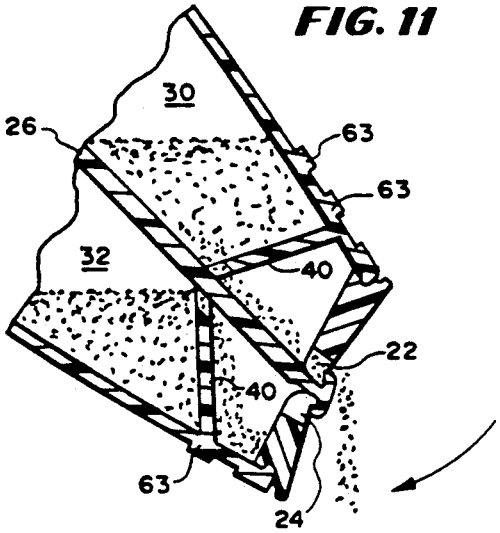
FIG. 11 is a cross sectional view similar to FIG. 10, showing the spice dispenser tipped further while still only providing a single spice therefrom.

FIGS. 10 and 11 show that when the other spice is desired, one merely tips the dispenser 10 in the other direction creating a like effect to that just described above.

Figure 9:
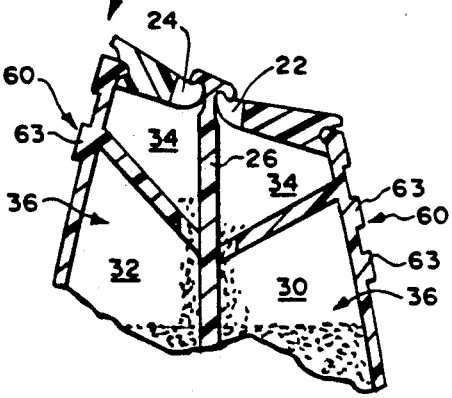
FIG. 9 is a cross sectional view similar to FIG. 8 and shows storage areas of the dispenser refilling with unused spices upon righting of the dispenser.

Upon returning the dispenser 10 to its usual upright position as shown in FIG. 9 the spices within the collection chamber portions 34 of each chamber section 30, 32 flow downwardly, along the flanges 40, through the opening 44 therein, and back into the holding portions 36 of the chamber sections 30 and 32, without contamination of one spice by the other.

Also, when the dispenser 10 is not in constant use, or is being stored, an angulated closure member 65 can be engaged within the slits 22 and 24 as shown in FIGS. 1, 2 and 4, straddling the dam 26 to keep the spices free of contaminants, and to keep the spices from spilling out if the dispenser 10 were accidentally knocked over.

To provide a clearer understanding of the manner in which the top sections 14 are engaged to the casing 12 and dam 26, as best shown in FIG. 5, each top section 14 is U shaped and includes two lateral upwardly curved arms 66 defining a slit forming recess 68 therebetween. The arms 66 engage within grooves 70 provided for same in an underside 71 of a T shaped head portion 72 of the dam 26. Once the arms 66 are engaged within the grooves 70, the top section 14, along a base portion 73 of the U, is pressed downwardly into the casing 12 until a circumferential cutout 80 on a bottom inset shoulder 82 of the top section 14 engages in a snap fit manner to an inwardly extending rib 84 set along the inner surface 42 of the casing 12, in the area of the flat 61, along a top edge 86 of the casing 12. For release of the top section 14 from the casing 12, such as required when the dispenser 10 is to be filled, one merely pushes upwardly on a radially outwardly extending flange 88 of the top section 14, causing disengagement of the cutout 80 of the top section 14 from the rib 84.

As described above, the dispenser 10 has a number of advantages, some of which have been described above and others of which are inherent in the invention.

Also, modifications can be proposed to the dispenser 10 without departing from the teachings of the invention. Accordingly the scope of the invention is only to be limited as necessitated by the accompanying claims.

I claim:

1. A spice dispenser for holding two spices therein and for dispensing only one spice at a time, the dispenser comprising: an oval, parabolic casing including planar top surface portions which angle downwardly toward each other at a center point of the top surface between the oval ends thereof; a dam extending vertically from a base of the casing upwardly to a level slightly above the top surface of the casing, said dam extending across the narrow extent of the oval casing, and being centrally located between the oval ends thereof to form two chambers within the casing; said planar top surface portions engaging said central dam and being engaged to the casing in a snap fit manner, each said top surface portion including a recess in an area adjacent said dam to form two parallel spaced apart traverse slits in the top surface of the casing, each slit leading to a respective chamber therebeneath; each chamber further including an angled flange therein extending radially upwardly from said dam to a periphery of the chamber, each flange including an opening therein lying along an area adjacent said dam.

2. A spice dispenser for holding two spices therein and for dispensing only one spice at a time, the dispenser comprising: an oval, parabolic casing including planar top surface portions which angle downwardly toward each other at a center point of the top surface between the oval ends thereof; a dam extending vertically from a base of the casing upwardly to a level slightly above the top surface of the casing, said dam extending across the narrow extent of the oval casing, and being centrally located between the oval ends thereof to form two chambers within the casing; said planar top surface portions engaging said central dam and being engaged to the casing in a snap fit manner, each said top surface portion including a recess in an area adjacent said dam to form two parallel spaced apart traverse slits in the top surface of the casing, each slit leading to a respective chamber therebeneath; each chamber further including an angled flange therein extending radially upwardly from said dam to a periphery of the chamber, each flange including an opening therein lying along an area adjacent said dam; and said casing including tactile indicia for outwardly indicating the identity of a corresponding chamber.

3. A spice dispenser for holding two spices therein and for dispensing only one spice at a time, the dispenser comprising: an oval, parabolic casing including planar top surface portions which angle downwardly toward each other at a center point of the top surface between the oval ends thereof; a dam extending vertically from a base of the casing upwardly to a level slightly above the top surface of the casing, said dam extending across the narrow extent of the oval casing, and being centrally located between the oval ends thereof to form two chambers within the casing; said planar top surface portions engaging said central dam and being engaged to the casing in a snap fit manner, each said top surface portion including a recess in an area adjacent said dam to form two parallel, spaced apart traverse slits in the top surface of the casing, each slit leading to a respective chamber therebeneath; each chamber further including an angled flange therein extending radially upwardly from said dam to a periphery of the chamber, each flange including an opening therein lying along an area adjacent said dam; said casing including tactile indicia for outwardly indicating the identity of a corresponding chamber; and said dispenser further including closure means engaging within the slits and extending across the dam therebetween.

* * * * *